US008726596B2

(12) United States Patent
Hohmann, Jr.

(10) Patent No.: US 8,726,596 B2
(45) Date of Patent: May 20, 2014

(54) HIGH-STRENGTH PARTIALLY COMPRESSED VENEER TIES AND ANCHORING SYSTEMS UTILIZING THE SAME

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

(21) Appl. No.: 13/425,930

(22) Filed: Mar. 21, 2012

(65) Prior Publication Data

US 2013/0247482 A1 Sep. 26, 2013

(51) Int. Cl.
*E04B 1/16* (2006.01)

(52) U.S. Cl.
USPC ..... 52/379; 52/513; 52/712; 52/713

(58) Field of Classification Search
USPC ..... 52/379, 513, 712, 713
See application file for complete search history.

(56) References Cited

U.S. PATENT DOCUMENTS

| | | | | |
|---|---|---|---|---|
| 819,869 | A | | 5/1906 | Dunlap |
| 903,000 | A | | 11/1908 | Priest, Jr. |
| 1,794,684 | A | | 3/1931 | Handel |
| 2,058,148 | A | | 10/1936 | Hard |
| 2,300,181 | A | | 10/1942 | Spaight |
| 2,605,867 | A | | 8/1952 | Goodwin |
| 2,780,936 | A | | 2/1957 | Hillberg |
| 2,929,238 | A | | 3/1960 | Kaye |
| 2,966,705 | A | | 1/1961 | Massey |
| 3,030,670 | A | | 4/1962 | Bigelow |
| 3,183,628 | A | | 5/1965 | Smith |
| 3,277,626 | A | * | 10/1966 | Brynjolfsson et al. ..... 52/713 |
| 3,309,828 | A | | 3/1967 | Tribble |
| 3,341,998 | A | | 9/1967 | Lucas |
| 3,377,764 | A | * | 4/1968 | Storch ..... 52/713 |
| 3,568,389 | A | | 3/1971 | Gulow |
| 3,964,226 | A | | 6/1976 | Hala et al. |
| 4,021,990 | A | | 5/1977 | Schwalberg |
| 4,227,359 | A | | 10/1980 | Schlenker |
| 4,305,239 | A | | 12/1981 | Geraghty |
| 4,373,314 | A | | 2/1983 | Allan |
| 4,382,416 | A | | 5/1983 | Kellogg-Smith |

(Continued)

FOREIGN PATENT DOCUMENTS

| | | |
|---|---|---|
| CH | 279209 | 3/1952 |
| GB | 2069024 A | 8/1981 |

OTHER PUBLICATIONS

Building Envelope Requirements, 780 CMR sec. 1304.0 et seq., 7th Edition, Aug. 28, 2008, 11 pages, Boston, MA, United States.

(Continued)

*Primary Examiner* — Brian Glessner
*Assistant Examiner* — Joshua Ihezie
(74) *Attorney, Agent, or Firm* — Silber & Fridman

(57) ABSTRACT

A high-strength pintle anchoring system for a cavity wall is disclosed. The high-strength pintle anchoring system employs a partially compressively reduced veneer tie that is cold-worked with the resultant body partially having substantially semicircular edges and flat surfaces therebetween. The edges are aligned to receive compressive forces transmitted from the outer wythe. The partially compressively reduced veneer tie, when part of the anchoring system, interengages with the receptor portions of a wall anchor and are dimensioned to preclude significant movement lateral with or normal to the inner wythe.

40 Claims, 7 Drawing Sheets

(56) References Cited

U.S. PATENT DOCUMENTS

| | | | | | |
|---|---|---|---|---|---|
| 4,438,611 | A | | 3/1984 | Bryant | |
| 4,473,984 | A | | 10/1984 | Lopez | |
| 4,596,102 | A | | 6/1986 | Catani et al. | |
| 4,598,518 | A | | 7/1986 | Hohmann | |
| 4,606,163 | A | | 8/1986 | Catani | |
| 4,738,070 | A | | 4/1988 | Abbott et al. | |
| 4,764,069 | A | | 8/1988 | Reinwall et al. | |
| 4,819,401 | A | | 4/1989 | Whitney, Jr. | |
| 4,827,684 | A | | 5/1989 | Allan | |
| 4,843,776 | A | | 7/1989 | Guignard | |
| 4,869,038 | A | * | 9/1989 | Catani | 52/410 |
| 4,869,043 | A | | 9/1989 | Hatzinikolas et al. | |
| 4,875,319 | A | | 10/1989 | Hohmann | |
| 4,946,632 | A | * | 8/1990 | Pollina | 264/33 |
| 4,955,172 | A | | 9/1990 | Pierson | |
| 5,063,722 | A | | 11/1991 | Hohmann | |
| 5,099,628 | A | | 3/1992 | Noland et al. | |
| 5,207,043 | A | | 5/1993 | McGee et al. | |
| 5,392,581 | A | | 2/1995 | Hatzinikolas et al. | |
| 5,408,798 | A | * | 4/1995 | Hohmann | 52/562 |
| 5,440,854 | A | | 8/1995 | Hohmann | |
| 5,454,200 | A | * | 10/1995 | Hohmann | 52/513 |
| 5,456,052 | A | | 10/1995 | Anderson et al. | |
| 5,490,366 | A | | 2/1996 | Burns et al. | |
| 5,598,673 | A | | 2/1997 | Atkins | |
| 5,634,310 | A | * | 6/1997 | Hohmann | 52/513 |
| 5,671,578 | A | * | 9/1997 | Hohmann | 52/562 |
| 5,755,070 | A | | 5/1998 | Hohmann | |
| 5,816,008 | A | | 10/1998 | Hohmann | |
| 6,209,281 | B1 | | 4/2001 | Rice | |
| 6,279,283 | B1 | * | 8/2001 | Hohmann et al. | 52/379 |
| 6,332,300 | B1 | | 12/2001 | Wakai | |
| 6,351,922 | B1 | | 3/2002 | Burns et al. | |
| 6,668,505 | B1 | * | 12/2003 | Hohmann et al. | 52/565 |
| 6,735,915 | B1 | * | 5/2004 | Johnson, III | 52/379 |
| 6,739,105 | B2 | * | 5/2004 | Fleming | 52/513 |
| 6,789,365 | B1 | * | 9/2004 | Hohmann et al. | 52/565 |
| 6,851,239 | B1 | * | 2/2005 | Hohmann et al. | 52/513 |
| 6,925,768 | B2 | | 8/2005 | Hohmann et al. | |
| 6,941,717 | B2 | * | 9/2005 | Hohmann et al. | 52/506.01 |
| 7,017,318 | B1 | * | 3/2006 | Hohmann et al. | 52/562 |
| 7,152,382 | B2 | | 12/2006 | Johnson, III | |
| 7,225,590 | B1 | | 6/2007 | diGirolamo et al. | |
| 7,325,366 | B1 | * | 2/2008 | Hohmann et al. | 52/513 |
| 7,415,803 | B2 | | 8/2008 | Bronner | |
| 7,562,506 | B2 | * | 7/2009 | Hohmann, Jr. | 52/714 |
| 7,587,874 | B2 | * | 9/2009 | Hohmann, Jr. | 52/714 |
| 7,735,292 | B2 | * | 6/2010 | Massie | 52/742.14 |
| 7,845,137 | B2 | | 12/2010 | Hohmann, Jr. | |
| 8,037,653 | B2 | | 10/2011 | Hohmann, Jr. | |
| 8,051,619 | B2 | | 11/2011 | Hohmann, Jr. | |
| 8,096,090 | B1 | * | 1/2012 | Hohmann et al. | 52/513 |
| 8,122,663 | B1 | * | 2/2012 | Hohmann et al. | 52/379 |
| 8,201,374 | B2 | * | 6/2012 | Hohmann, Jr. | 52/379 |
| 2001/0054270 | A1 | | 12/2001 | Rice | |
| 2004/0083667 | A1 | * | 5/2004 | Johnson, III | 52/379 |
| 2004/0216408 | A1 | | 11/2004 | Hohmann, Jr. | |
| 2004/0216413 | A1 | | 11/2004 | Hohmann et al. | |
| 2004/0216416 | A1 | | 11/2004 | Hohmann et al. | |
| 2008/0141605 | A1 | | 6/2008 | Hohmann | |
| 2010/0037552 | A1 | | 2/2010 | Bronner | |
| 2010/0071307 | A1 | | 3/2010 | Hohmann, Jr. | |
| 2010/0101175 | A1 | | 4/2010 | Hohmann | |
| 2010/0257803 | A1 | | 10/2010 | Hohmann, Jr. | |
| 2011/0047919 | A1 | | 3/2011 | Hohmann, Jr. | |
| 2011/0146195 | A1 | | 6/2011 | Hohmann, Jr. | |
| 2011/0173902 | A1 | | 7/2011 | Hohmann, Jr. et al. | |
| 2011/0277397 | A1 | | 11/2011 | Hohmann, Jr. | |
| 2012/0285111 | A1 | | 11/2012 | Johnson, III | |

OTHER PUBLICATIONS

Hohmann & Barnard, Inc.; Product Catalog, 2003, 44 pages, Hauppauge, New York, United States.

Hohmann & Barnard, Inc.; Product Catalog, 2009, 52 pages, Hauppauge, New York, United States.

* cited by examiner

HIGH-STRENGTH PARTIALLY COMPRESSED VENEER TIES AND ANCHORING SYSTEMS UTILIZING THE SAME

BACKGROUND OF THE INVENTION

1. Field of the Invention

This invention relates to an improved anchoring arrangement for use in conjunction with cavity walls having an inner wythe and an outer wythe. More particularly, the invention relates to construction accessory devices, namely, specially dimensioned veneer ties with high-strength partial compressions and anchoring systems related thereto. The veneer ties are for emplacement in the outer wythe and are further accommodated by receptors in the cavity, which receptors extend from the inner wythe to encapture the specially configured veneer ties. The invention is applicable to structures having an outer wythe of brick or stone facing in combination with an inner wythe of either masonry block or dry wall construction.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer.

Prior tests have shown that failure of anchoring systems frequently occur at the juncture between the pintle of the veneer tie and the receptor portion of the wall anchor. This invention addresses the need for a high-strength veneer tie suitable for use with both a masonry block or a dry wall construction that provides a strong pintle-to-receptor connection.

Early in the development of high-strength anchoring systems a prior patent, namely U.S. Pat. No. 4,875,319 ('319), to Ronald P. Hohmann, describes a molded plastic clip that ties together a reinforcing wire and a veneer tie. The assignee of '319, Hohmann & Barnard, Inc., now a MiTek-Berkshire Hathaway company, successfully commercialized the device under the SeismiClip trademark. For many years the white plastic clip tying together the veneer anchor and the reinforcement wire in the outer wythe has been a familiar item in commercial seismic-zone buildings.

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Because of this, the veneer facing material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

The use of wire formatives in cavity wall construction have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block to protect against wythe separation. A balancing of mortar and wire formatives needs to be struck to ensure veneer tie stability within the outer wythe. The present high strength partially compressed veneer tie greatly assists in maintaining this balance in the mortar joint.

Besides earthquake protection requiring high-strength anchoring systems, the failure of several high-rise buildings to withstand wind and other lateral forces has resulted in the promulgation of more stringent Uniform Building Code provisions. The high-strength partially compressively reduced veneer tie is a response thereto. The inventor's related anchoring system products have become widely accepted in the industry.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,454,200 | Hohmann | Oct. 3, 1995 |
| 6,668,505 | Hohmann et al. | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann | Mar. 28, 2006 |
| 7,325,366 | Hohmann | Feb. 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—D. Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—B. J. Schwalber—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,869,038—M. J. Catani—Issued Sep. 26, 1989 Discloses a veneer wall anchor system having in the interior wythe a truss-type anchor, similar to Hala et al. '226 supra, but with horizontal sheetmetal extensions. The extensions are interlocked with bent wire pintle-type wall ties that are embedded within the exterior wythe.

U.S. Pat. No. 4,875,319—R. Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,454,200—R. Hohmann—Issued October 1995 Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505—Hohmann et al.—Issued Dec. 30, 2003 Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365—R. Hohmann et al.—Issued Sep. 14, 2004 Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005 Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann—Issued Mar. 28, 2006 Discloses an anchoring system with low-profile wall ties in which insertion portions of the wall anchor and the veneer anchor are compressively reduced in height.

U.S. Pat. No. 7,325,366—Hohmann—Issued Feb. 5, 2008 Discloses snap-in veneer ties for a seismic construction system in cooperation with low-profile, high-span wall anchors.

None of the above anchors or anchoring systems provide a veneer tie having a high-strength partially compressively reduced veneer tie for fulfilling the need for enhanced compressive and tensile properties. This invention relates to an improved anchoring arrangement for use in conjunction with cavity walls having an inner wythe and an outer wythe and meets the heretofore unmet need described above.

SUMMARY

In general terms, the invention disclosed hereby is a high-strength pintle and an anchoring system utilizing the same for cavity walls having an inner and outer wythe. The system includes a wire-formative veneer tie for emplacement in the outer wythe. The high-strength construction system hereof is applicable to construction of a wall having an inner wythe which can either be of dry wall construction or masonry block and an outer wythe and to insulated and non-insulated structures. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct), a wire veneer tie, and, optionally, a continuous wire reinforcement is provided. The invention contemplates that the high-strength partially compressively reduced veneer ties are wire formatives depending into the wall cavity for connections between the veneer tie and the wall anchor.

In the first embodiment of this invention, the inner wythe is constructed from a masonry block material, the masonry anchor is a wire formative attached to a truss- or ladder-type reinforcement in a manner similar to the wall anchor shown in Hohmann, U.S. Pat. No. 6,789,365. The eye wires there extend into the cavity between the wythes. Each pair of eye wires accommodates the interengagement therewith of the high-strength pintles of the veneer ties.

The veneer tie is then positioned so that the insertion end thereof is embedded in the bed joint of the outer wythe. The construction of the veneer tie results in an orientation upon emplacement so that the widest part of the veneer tie is subjected to compressive and tensile forces. As the eye wires have sealed eyelets or loops with predetermined dimensions the horizontal movement of the construct is restricted accordingly.

In a second embodiment with a masonry block inner wythe, a construct is shown that employs thicker than usual insulation requiring high-span components. The novel high-strength veneer tie is shown in a functional cooperative relationship with the high-span components.

In the third embodiment of this invention, the inner wythe is a dry wall construct. Here, the dry-wall anchor is a metal stamping and is attached by sheetmetal screws to the metal vertical channel members of the wall. Each dry-wall anchor accommodates in horizontally extending portions, the high-strength partially compressively reduced wire formative veneer tie. In this embodiment the insertion end of the veneer tie is then positioned on the outer wythe so that a continuous reinforcement wire can be snapped into and is secured to the outer wythe anchor. The snap-in feature of the anchor here replaces the traditional function of the seismic clip for accommodating a straight wire run (see U.S. Pat. No. 4,875,319) and receiving the open end of the box tie. This anchor and a straight wire run are embedded in the bed joint of the outer wythe.

It is an object of the present invention to provide in an anchoring system having an outer wythe and an inner wythe, a high-strength partially compressed veneer tie that interengages a wall anchor.

It is another object of the present invention to provide a specialized veneer tie that is partially compressively reduced at specific locations along the veneer tie to provide a high strength interlock between the anchor and the outer wythe.

It is another object of the present invention to provide labor-saving devices to simplify seismic and non-seismic high-strength installations of brick and stone veneer and the securement thereof to an inner wythe.

It is yet another object of the present invention to provide a cold worked wire formative that is characterized by high resistance to compressive and tensile forces.

It is a further object of the present invention to provide an anchoring system for cavity walls comprising a limited number of component parts that are economical of manufacture resulting in a relatively low unit cost.

It is yet another object of the present invention to provide an anchoring system which restricts lateral and horizontal movements of the facing wythe with respect to the inner wythe, but is adjustable vertically.

It is a feature of the present invention that when the veneer tie is inserted into the receptors therefor, the interconnection points are oriented so that the widest portion thereof is subjected to compressive to tensile forces.

It is another feature of the present invention that the veneer ties are utilizable with either a masonry block having aligned or unaligned bed joints or for a dry wall construct that secures to a metal stud.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
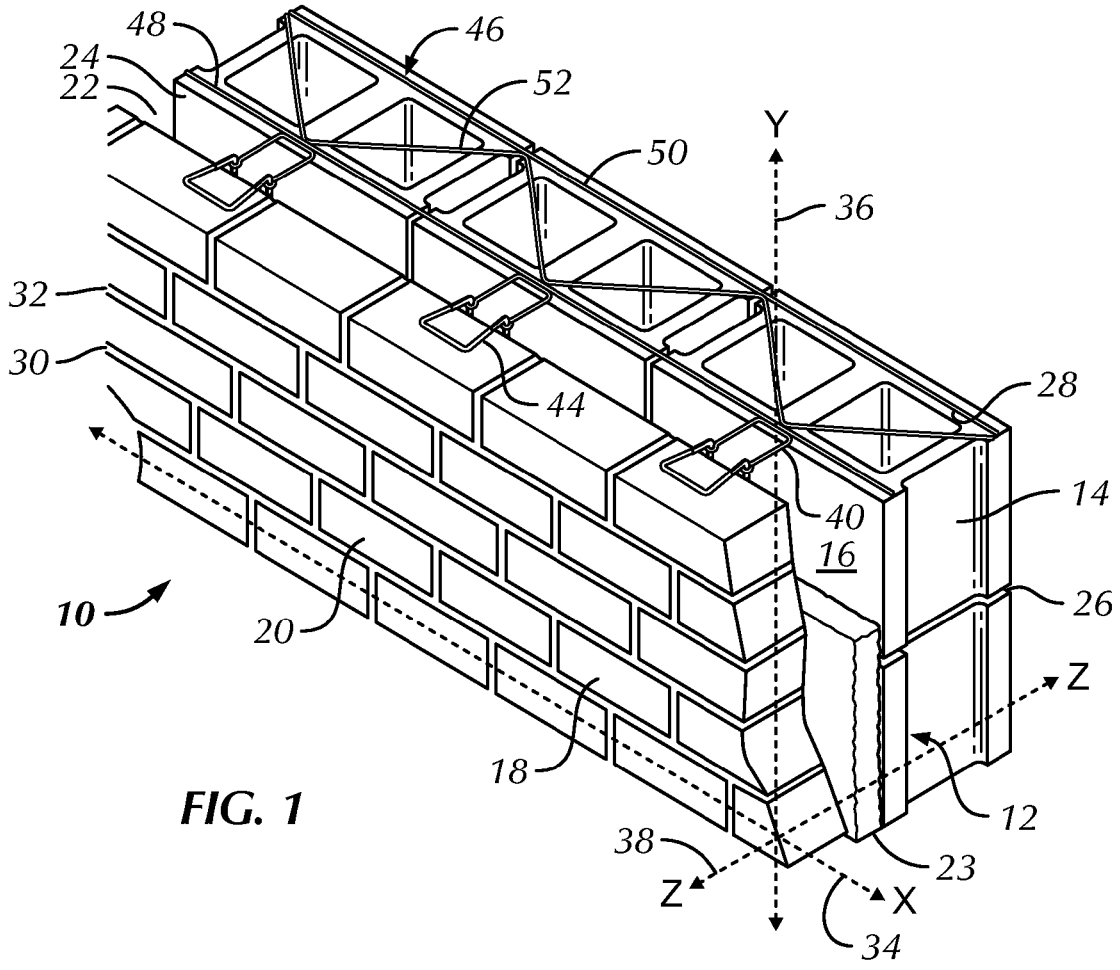
FIG. 1 is a perspective view of a first embodiment of an anchoring system having a partially compressed veneer tie of this invention interengaged with a welded wall anchor and shows a wall with an inner wythe of masonry block and an outer wythe of brick veneer.

In the embodiments described herein sections of the wire components of the veneer ties are cold-worked or otherwise partially flattened resulting in greater tensile and compressive strength and thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

Before proceeding to the detailed description, the following definitions are provided. For purposes of defining the invention at hand, a compressed portion of a wire formative has been compressed by cold working so that the resultant body is substantially semicircular at the edges and has flat surfaces therebetween. In use the rounded edges are aligned so as to receive compressive forces transmitted from the veneer or outer wythe, which forces are generally normal to the facial plane thereof. In the discussion that follows the width of the compressed portion is also referred to as the major axis and the thickness is referred to as the minor axis.

As the compressive forces are exerted on the compressed portion, the compressed portion withstand forces greater than uncompressed portions of the wire formative formed from the same gage wire. Data reflecting the enhancement represented by the cold-worked compressed portion is included hereinbelow.

The description which follows is of three embodiments of anchoring systems utilizing the high-strength partially compressed veneer tie devices of this invention, which devices are suitable for nonseismic and seismic cavity wall applications. Although each high-strength partially compressed veneer tie is adaptable to varied inner wythe structures, two of the embodiments apply to cavity walls with masonry block inner wythes, and the remaining embodiment to a cavity wall with a dry wall (sheetrock) inner wythe. The wall anchor of the first embodiment is adapted from that shown in U.S. Pat. No. 6,789,365 of the inventors hereof.

Referring now to FIGS. 1 through 6 and 9, the first embodiment of the anchoring system hereof including a high-strength partially compressed anchoring system of this invention is shown and is referred to generally by the number 10. In this embodiment, a wall structure 12 is shown having a backup wall or inner wythe 14 of masonry blocks 16 and a veneer facing or outer wythe 18 of facing brick or stone 20. Between the backup wall 14 and the facing wall 18, a cavity 22 is formed, which cavity 22 extends outwardly from surface 24 of backup wall 14. Optionally, the cavity is filled with insulation 23.

In this embodiment, successive bed joints 26 and 28 are formed between courses of blocks 16 and the joints are substantially planar and horizontally disposed. Also, successive bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction. Selected bed joint 26 and bed joint 30 are constructed to align, that is to be substantially coplanar, the one with the other.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 10 includes a wall anchor 40 constructed for embedment in bed joint 28, which, in turn, includes a free end 42 with one or more legs or receptor portions 54 extending into cavity 22. Further, the device 10 includes a wire formative veneer tie or anchor 44 for embedment in bed joint 31.

Figure 7:
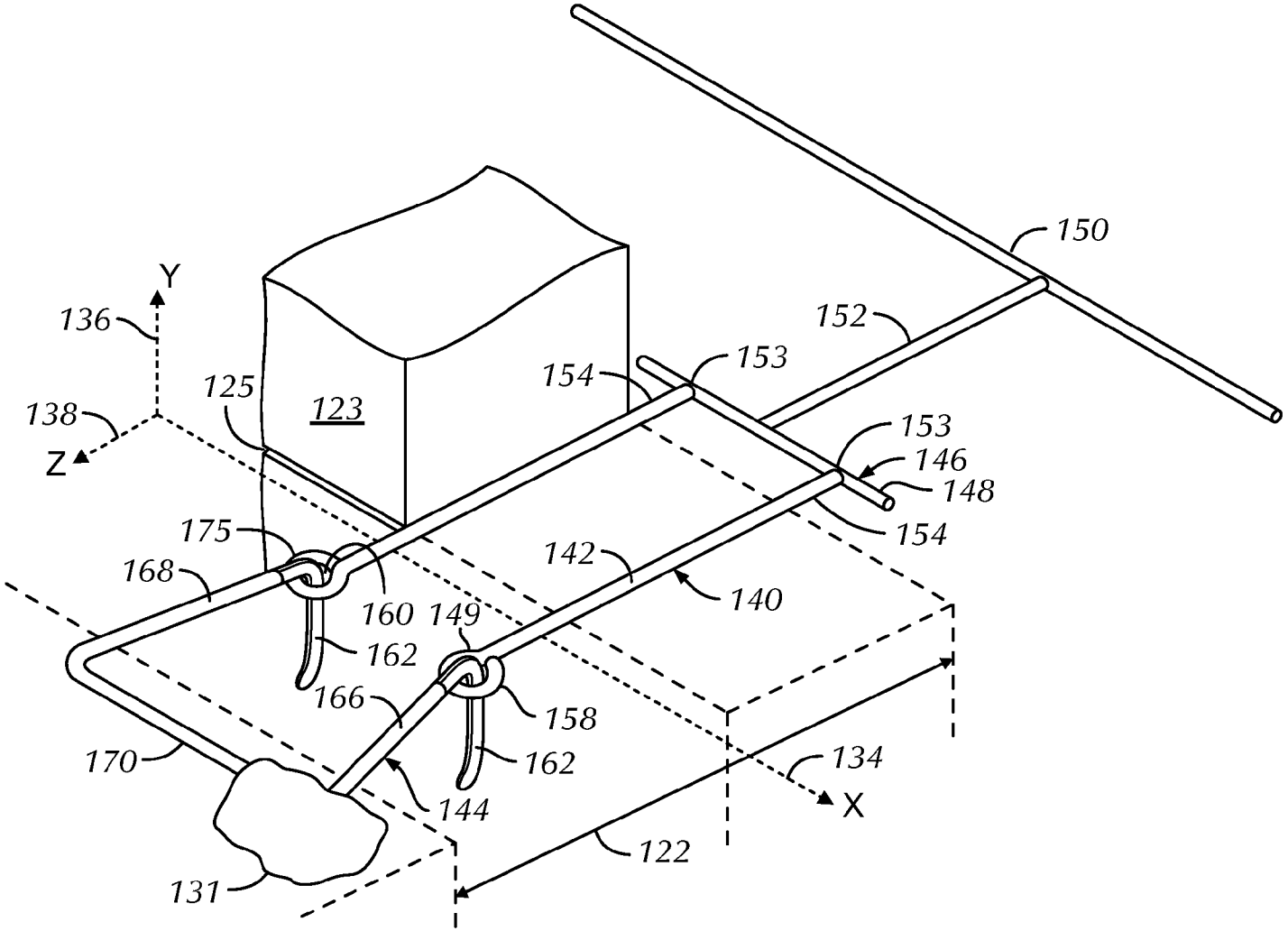
FIG. 7 is a partial perspective view of a second embodiment of an anchoring system having a partially compressed veneer tie of this invention interengaged with a wire formative anchor emplaced in a high-span cavity wall.

The wall anchor 40 is shown in FIG. 1 as being emplaced on a course of blocks 16 in preparation for embedment in the mortar of bed joint 28. In the best mode of practicing this embodiment, a truss-type wall reinforcement wire portion 46 is constructed of a wire formative with two parallel continuous straight wire members 48 and 50 spaced so as, upon installation, to each be centered along the outer walls of the masonry blocks 16. Intermediate wire bodies or cross rods 52 are interposed therebetween and connect wire members 48 and 50 forming the connecting portions of the truss structure 46. Alternatively, the cross rods are formed in a ladder shaped manner as shown in FIG. 7.

Figure 2:
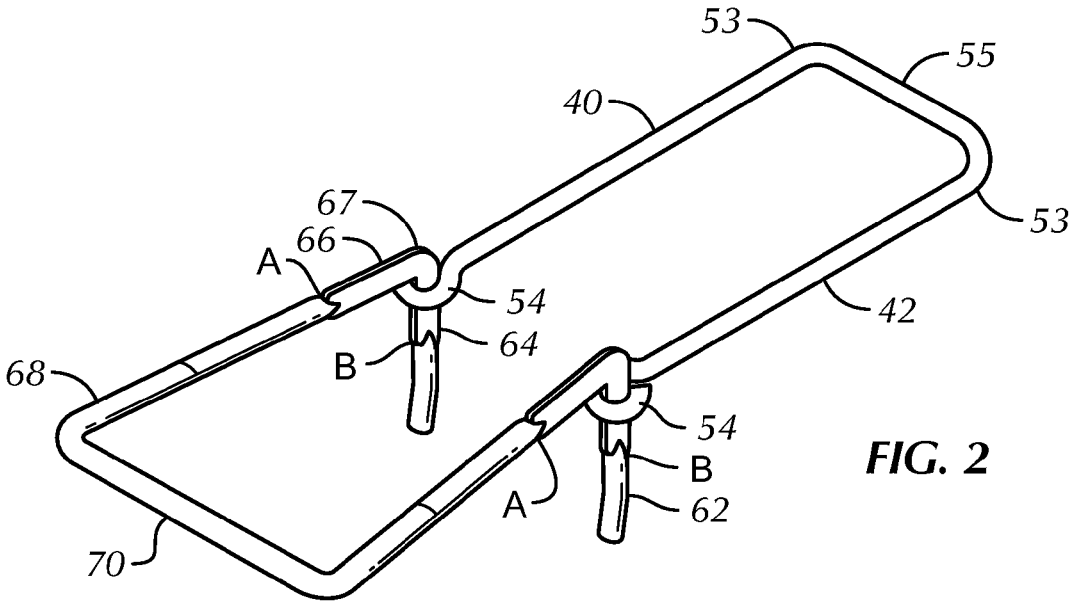
FIG. 2 is a perspective view of the veneer tie of FIG. 1 interengaged with a wire formative anchor.
Figure 3:
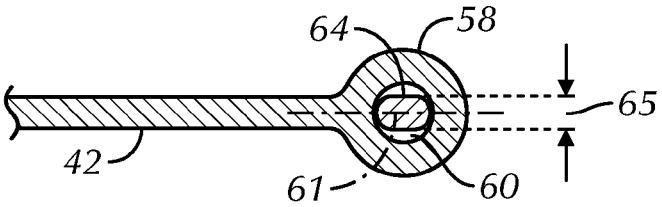
FIG. 3 is a partial cross-sectional view of the anchoring system of FIG. 1 on a substantially horizontal plane showing the receptor portion of the wall anchor and the pintle of the veneer tie.
Figure 4:
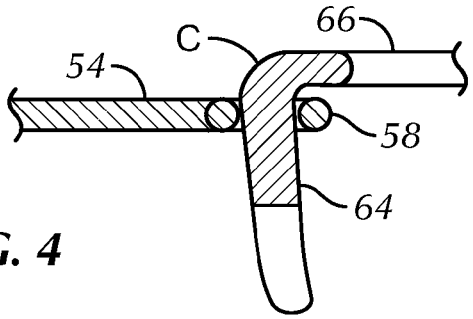
FIG. 4 is a partial cross-sectional view of the anchoring system of FIG. 1 on a substantially vertical plane showing the receptor portion of the wall anchor and the pintle of the veneer tie.

At intervals along the wall reinforcement 46, the wall anchor 40 legs 53 are attached thereto at wire member 48. Alternatively, as shown in FIG. 2, the legs 53 are connected with a rear leg 55 and the rear leg 55 is, in turn, attached to the wall reinforcement 46. The free end 42 and the receptor portions 54 extend into cavity 22 to the veneer tie 44. As will become clear by the description which follows, the spacing between the receptor portions 54 is constructed to limit the x-axis movement of the construct. Each receptor portion 54 has at the end opposite the attachment end an eyelet 58 formed contiguously therewith. The eyelet 58 is preferably welded closed and has a substantially circular opening or eye 60.

Upon installation, the eye or aperture 60 of eyelet 58 is constructed to be within a substantially horizontal plane normal to exterior surface 24. The aperture 60 is dimensioned to accept an interconnecting portion or pintle and an adjacent compressed portion of the veneer tie or anchor 44 therethrough and has a slightly larger opening than that required to accommodate the pintle and the compressed portion. This relationship minimizes the movement of the construct in along a z-vector and in an xz-plane. For positive engagement, the aperture 60 of eyelet 58 is sealed, through welding or similar method, forming a closed loop.

The veneer tie 44 is, when viewed from a top or bottom elevation, generally U-shaped and is dimensioned to be accommodated by the pair of eyelets 58 previously described. The tie 44 has an insertion portion 70 disposed in the bed joint 31 and a cavity portion 62 that engages the anchor 40. The cavity portion 62 leg or leg portion 68 extends from the insertion portion 70 into the cavity 22. A joint or joint portion 66 is contiguous with the leg 68 and extends into a pintle or pintle portion 64. The veneer tie 44 is a wire formative and is partially compressively reduced from a point medial (A) the leg 68 through the joint 66 to a point medial (B) the pintle 64 to form a partially compressed portion (C). As more clearly seen in FIGS. 4 and 5, the partially compressed portion C has been compressively reduced so that, when viewed as installed, the pintle 64 cross-section taking in a horizontal or an xz-plane that includes the longitudinal axis of the receptor 58 shows the greatest dimension 61 substantially oriented along a z-vector. Similarly, when viewed as installed, the pintle cross-section taking in a vertical plane that includes the longitudinal axis of the wire member 54 shows the major axis dimension 61 substantially oriented along a z-vector.

Figure 5:
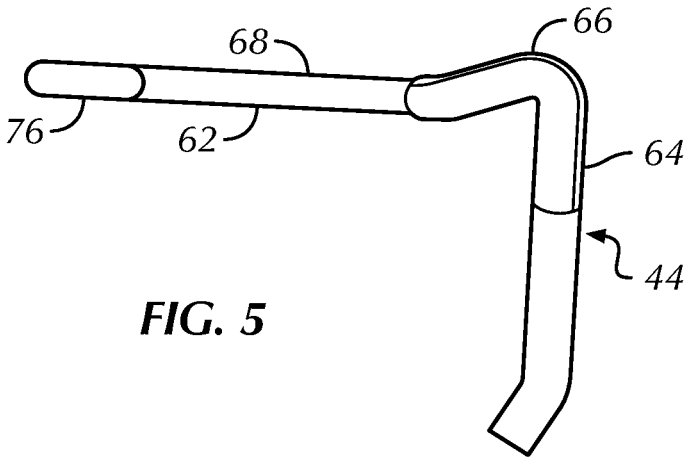
FIG. 5 is a side view of an alternative veneer tie for use with the anchoring system of FIG. 1.
Figure 6:
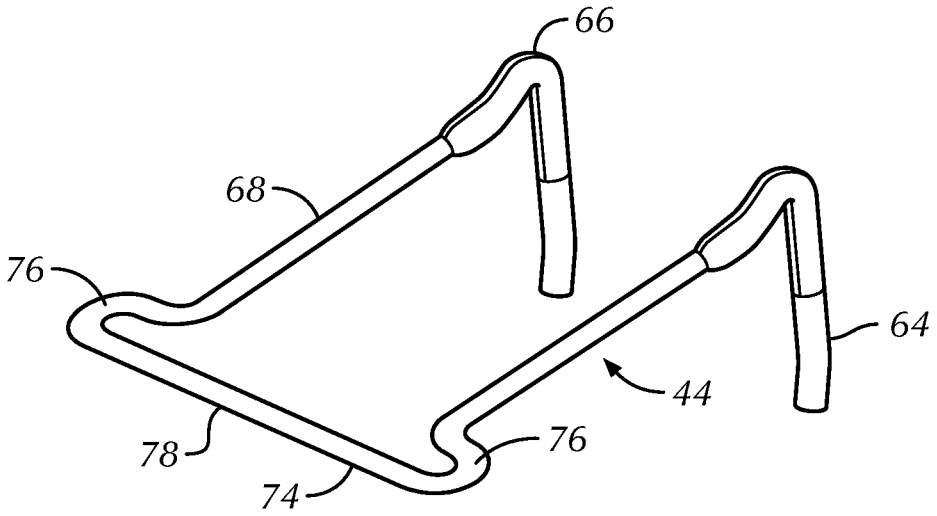
FIG. 6 is a perspective view of the partially compressed veneer tie of FIG. 5.

The veneer tie 44 with an alternative design insertion portion 74 is shown in FIGS. 5 and 6. The veneer tie 44, when viewed from a top or bottom elevation, is a modified U-shaped design and is dimensioned to be accommodated by the pair of eyelets 58 previously described. The tie 44 has an insertion portion 74 for disposition in the bed joint 31 and a cavity portion 62 that engages the anchor 40. The insertion portion 74 is configured to maximize surface contact with the mortar in the bed joint 31. The insertion portion 74 has two hooks 76 that extend from the leg or leg portion 68 of the cavity portion 62 and are contiguous with and connected by an insertion bar 78. A joint or joint portion 66 of the cavity portion 62 is contiguous with the leg 68 and extends into a pintle or pintle portion 64. The veneer tie 44 is a wire formative and is partially compressively reduced from a point medial (A) the leg 68 through the joint 66 to a point medial (B) the pintle 64 to form a partially compressed portion (C). As more clearly seen in FIGS. 3 and 4, the partially compressed portion C has been compressively reduced so that, when viewed as installed, the cross-section taking in a horizontal or an xz-plane that includes the longitudinal axis of the receptor 58 shows the greatest dimension 61 substantially oriented along a z-vector. Similarly, when viewed as installed, the cross-section taking in a vertical plane that includes the longitudinal axis of the wire member 54 shows the major axis dimension 61 substantially oriented along a z-vector. The cross-sectional illustrations show the manner in which wythe-to-wythe and side-to-side movement is limited by the close fitting relationship between the partially compressed portion C and the receptor openings. The minor axis 65 of the partially compressed portion C is optimally between 30 to 75% of the diameter of the wire formative and results in a veneer tie having compressive/tensile strength 130% of the original wire formative material.

Figure 9:
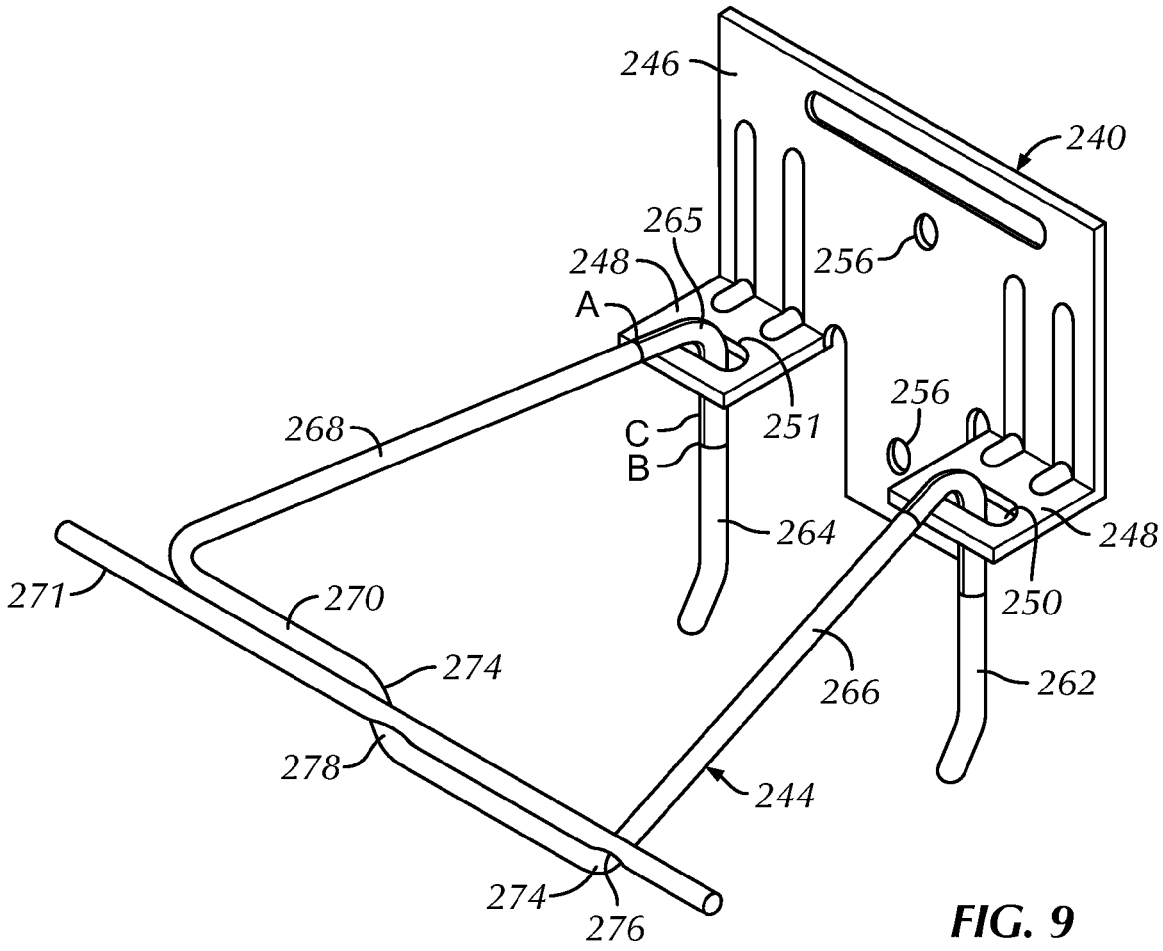
FIG. 9 is a partial perspective view of FIG. 8 showing details of the wall anchor, the veneer tie with partially compressively reduced pintles, and the continuous wire-reinforcement; and, FIG. 10 is a cross-sectional view of cold-worked wire used in the formation of the partially compressively reduced pintles hereof and showing resultant aspects of continued compression.

The description which follows is of a second embodiment of the high-strength pintle anchoring system. In this embodiment the wall anchor portion is adapted from the high-span anchor and wall reinforcement device of U.S. Pat. No. 6,668,505 to Hohmann, et al. For ease of comprehension, where similar parts are shown, reference designators "100" units higher than those previously employed are used. Thus, the veneer tie 144 of the second embodiment is analogous to the veneer tie 44 of the first embodiment. Referring now to FIGS. 7 and 9, the second embodiment of a high-strength pintle anchoring system of this invention is shown and is referred to generally by the numerals 140 for the wall anchor, 144 for the veneer tie, and 146 for the backup wall reinforcement. As this embodiment is similar to the first embodiment, the wall structure is partially shown, but the full wall structure of FIG. 1 is incorporated herein by reference.

The backup wall is insulated with strips of insulation 123 attached to the cavity surface of the backup wall and has seams 125 between adjacent strips coplaner with adjacent bed joints. In this embodiment, the cavity 122 is larger-than-normal and has a 5-inch span. For purposes of discussion, the exterior surface of the insulation 125 contains a horizontal line of x-axis 134 and an intersecting vertical line or y-axis 136. A horizontal line or z-axis 138, normal to the xy-plane, also passes through the coordinate origin formed by the intersecting x- and y-axes.

The wall anchor 140 is shown in FIG. 7 and has a free end or extension that spans the insulation portion or extension 142 for interconnection with veneer tie 144. In this embodiment, a ladder-type wall reinforcement 146 is constructed of a wire formative with two parallel continuous straight side wire members 148 and 150 spaced so as, upon installation, to each be centered along the outer walls of the masonry blocks. An intermediate wire body 152 is interposed therebetween and is butt welded to wire members 148 and 150, thus separating and connecting side wires 148 and 150 of reinforcement 146.

At intervals along the ladder-type reinforcement 146, spaced pairs of transverse wire attachment members or ends 153 are fusibly attached by electric resistance welding in accord with ASTM Standard Specification A951. These of wire members 153 have an extended leg portion 142 that spans the cavity 122 and has a free end 149 contiguous therewith and opposite the attachment end. The spacing therebetween limits the x-axis movement of the construct. Each transverse wire member 153 has at the end opposite the attachment end an eyelet or receptor portion 158 formed continuous therewith. Upon installation, the receptor opening or eye 160 is constructed to be within a substantially horizontal or xz-plane, which is normal to the cavity walls. The receptor openings 160 is horizontally aligned to accept the downwardly bent pintle portion 162 of veneer tie 144 threaded therethrough. The receptor openings 160 are slightly greater than the width or major axis of the pintle 162 and the pintle portion fits snugly therewithin. These dimensional relationships minimize the x- and z-axis movement of the construct. For differing applications, the pintle portion of the veneer tie 144 is available in a variety of lengths.

In this embodiment, the veneer tie 144 is a cold-worked wire formative, and, when viewed from a top or bottom elevation, generally box-shaped. As more descriptively shown in FIGS. 4 and 5, the veneer tie 144 is dimensioned so that the partially compressively reduced pintles 162 thereof have a major axis, defined hereinabove, nearing the opening or inner diameter of receptors 158. The partially compressively reduced pintle portions 162 are connected to an insertion end portion 170 for disposition in the bed joint 131. The pintle portion 162 form an interengaging end portion 175 for disposition in the receptor portion 158. A veneer tie more fully shown in FIGS. 5 and 6 is interchangeable with the anchoring system of this embodiment.

In the second embodiment in adapting the veneer tie 144 for high-strength applications, it is noted that the above-described arrangement of wire formatives is strengthened by the cold working thereof. In the past, while compressively altering wire formatives is taught by the patents of the inventors hereof, namely, U.S. Pat. Nos. 6,668,505 and 7,017,318, the teaching is to reduce the height of the wire formative inserted into the bed joint or between insulative panels. In this invention, in contrast to these past inventions, the compressive altering of wire formatives is found to enhance the strength of existing specified wire formatives to create anchoring systems with superior resistance to environmental forces, especially those exerted substantially normal to the exterior face of the outer wythe.

The partially compressively reduced pintles 162 portion C of veneer tie 144 are considerably compressed while maintaining the same mass of material per linear unit as the adjacent wire formative. The resultant width or major axis of the partially compressively reduced pintle 162 and portion C are increased so that, upon installation, the widths are dimensioned to have a close fitting relationship with receptor opening 160. The cold working enhances the mounting strength of veneer tie 144 and resist force vectors along the z-axis 138. The insertion portion of the veneer tie is considerably compressed with the vertical height being reduced. The insertion portion of the veneer tie has been strengthened in several ways. First, in place of the standard 9-gage (0.148-inch diameter) wall reinforcement wire, a 3/16-inch (0.187-inch diameter) wire is used. As a general rule, compressive reductions up to 75% are utilized and high-span strength calculations are based thereon.

The description which follows is of a third embodiment of the high-strength pintle anchoring system. For ease of comprehension, where similar parts are used reference designators "200" units higher are employed. Thus, the veneer tie 244 of the third embodiment is analogous to the veneer tie 44 of the first embodiment.

Figure 8:
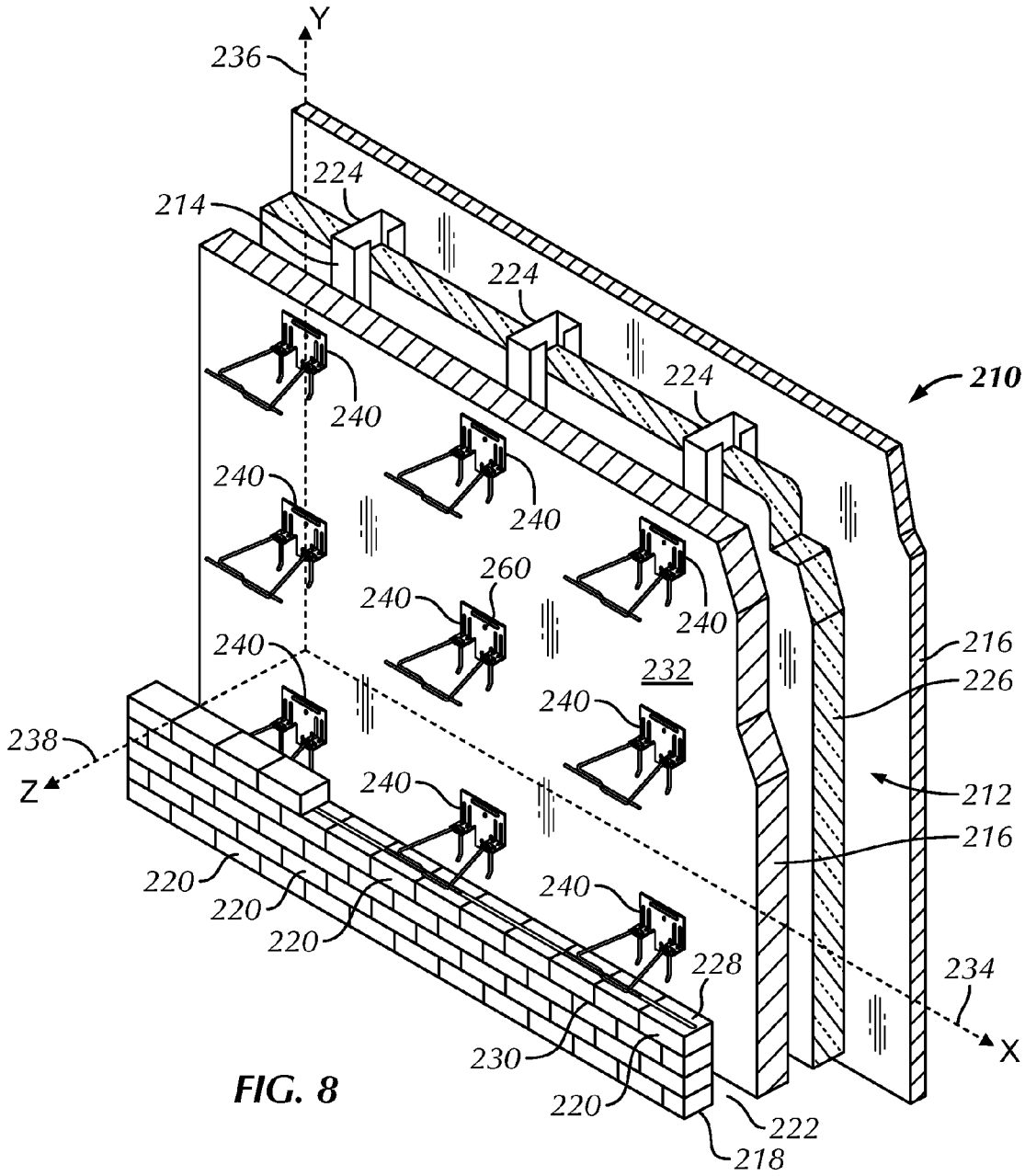
FIG. 8 is a perspective view of a third embodiment of an anchoring system having a partially compressed veneer tie of this invention interengaged with a sheetmetal wall anchor mounted on a drywall inner wythe and an outer wythe of brick veneer and a reinforcement wire set within the veneer tie.
Figure 10:
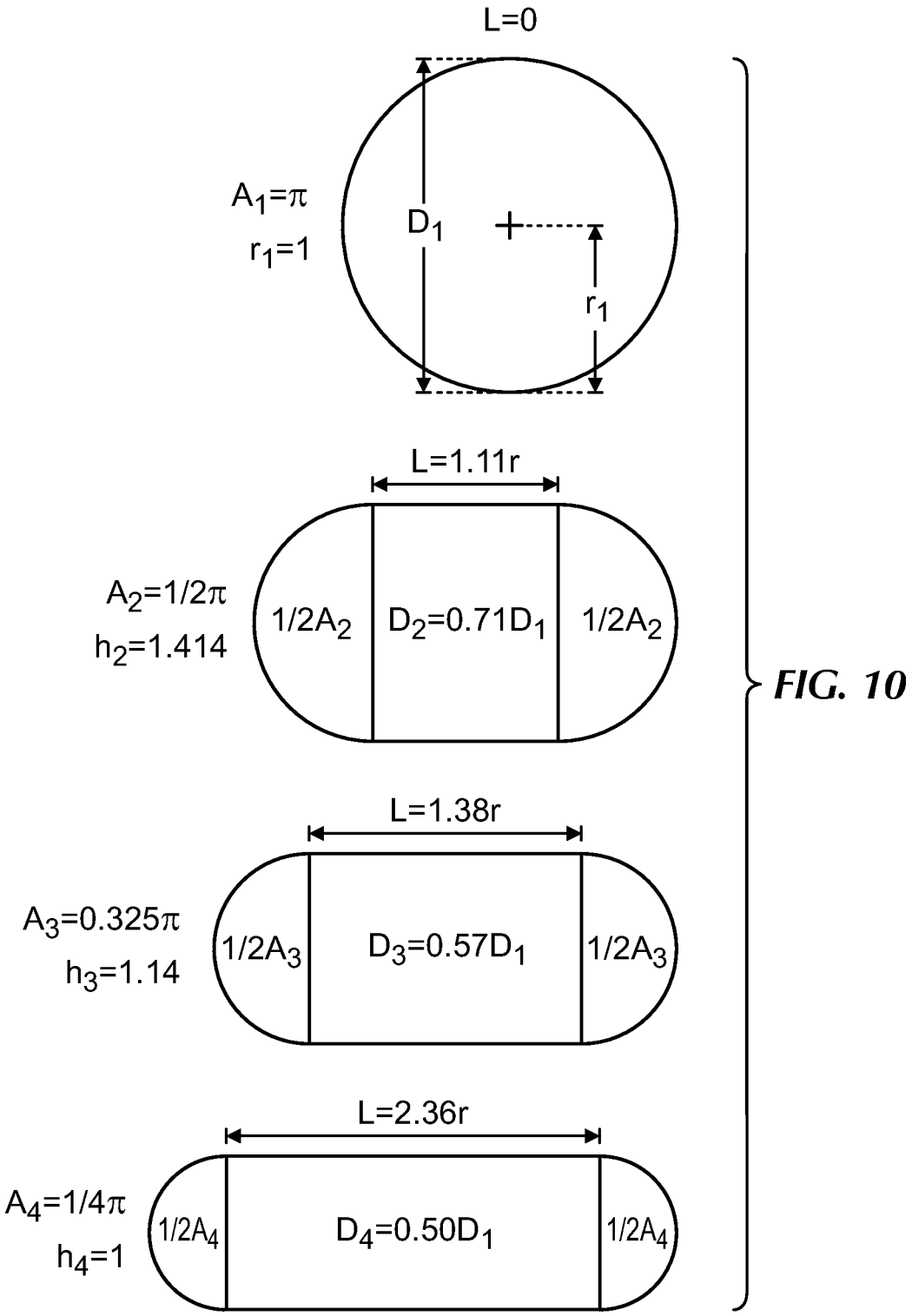

Referring now to FIGS. 8 through 10, the third embodiment of the high-strength pintle anchoring system is shown and is referred to generally by the numeral 210. The system 210 employs a sheetmetal wall anchor 240, Catalog #HB-200 manufactured by Hohmann and Barnard, Inc., a MiTek-Berkshire Hathaway company, Hauppauge, N.Y. 11788. The dry wall structure 212 is shown having an interior wythe 214 with wallboard 216 as the interior and exterior facings thereof. An exterior or outer wythe 218 of facing brick 220 is attached to dry wall structure 212 and a cavity 222 is formed therebetween. The dry wall structure 212 is constructed to include, besides the wallboard facings 216, vertical channels 224 with insulation layers 226 disposed between adjacent channel members 224. Selected bed joints 228 and 230 are constructed to be in cooperative functional relationship with the veneer tie described in more detail below.

For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The system 210 includes a dry wall anchor 240 constructed for attachment to vertical channel members 224, for embedment in joint 228 and for interconnecting with the veneer tie 244.

Reference is now directed to the L-shaped, surface-mounted sheetmetal bracket or wall anchor 240 comprising a mounting portion or base plate member 246 and free end projecting into the cavity 222 with pintle-receiving portion(s) 248. The projecting or extending portions 248 are punched-out from the base plate member 246 so as to have, upon installation, horizontally disposed apertures which, as best seen in FIG. 9, provide a pair of wire-tie-receiving receptors 251. The apertures 250 are substantially circular configurations and are formed in plate members 248. Upon installation the projecting portions 248 are thus disposed substantially at right angles with respect to the plate member 246. To ease tolerance stack up receptors 251 may be slightly elongated along the x-axis thereof. The plate member 246 is also provided with mounting holes 256 at the upper and lower ends thereof.

As is best seen in FIG. 8, the projecting portions 248 are spaced from the plate member 246 and are adapted to receive the pintles 262 of veneer tie 244 therewithin. In the fabrication of the dry wall as the inner wythe of this construction system 210, the channel members 224 are initially secured in place. In this regard, the channel members 224 may also comprise the standard framing member of a building. Sheets of exterior wallboard 216, which may be of an exterior grade gypsum board, are positioned in abutting relationship with the forward flange of the channel member 224. While the insulating layer 226 is shown as panels dimensioned for use between adjacent column 224, it is to be noted that any similarly suited rigid of flexible insulating material may be used herein with substantially equal efficacy.

After the initial placement of the flexible insulation layer 226 and the wallboard 216, the veneer anchors 240 are secured to the surface of the wallboard 216 in front of channel members 224. The sheetmetal Catalog #HB-200 (Hohmann & Barnard, Inc., Hauppauge, N.Y. 11788). Thereafter, sheet-metal screws 260 are inserted into the mounting holes 256 to fasten the anchor 240 to the channel member 224.

The veneer tie 244 is, when viewed either as a top or bottom elevation is substantially a U-shaped member and is dimensioned to be accommodated within apertures 250 previously described. The tie 244 has an insertion portion 270 disposed in the bed joint 228 and a cavity portion 266 that engages the anchor 240. The cavity portion 266 has a leg or leg portion 268 that extends from the insertion portion 270 into the cavity 222. A joint or joint portion 265 is contiguous with the leg 268 and extends into a pintle or pintle portion 262. The veneer tie 244 is a wire formative and is partially compressively reduced from a point medial (A) the leg 268 through the joint 265 to a point medial (B) the pintle 262 to form a partially compressed portion (C). Similar to FIGS. 4 and 5, the partially compressed portion C has been compressively reduced so that, when viewed as installed, the cross-section taking in a horizontal or an xz-plane that includes the longitudinal axis of the receptor 250 shows the greatest dimension substantially oriented along a z-vector. Similarly, when viewed as installed, the cross-section taking in a vertical plane that includes the longitudinal axis of the receptor 250 shows the major axis dimension substantially oriented along a z-vector. Wythe-to-wythe and side-to-side movement is limited by the close fitting relationship between the partially compressed portion C and the receptor openings. The minor axis of the partially compressed portion C is optimally between 30 to 75% of the diameter of the wire formative and results in a veneer tie having compressive/tensile strength 130% of the original wire formative material. The anchor 240 of this embodiment may be alternatively interengaged with the veneer ties 44 and 144.

The insertion portion 270 is optionally configured to accommodate therewithin in a reinforcement wire or straight wire member 271 of predetermined diameter. The insertion portion 270 contains two housings 274 impressed therein. Each housing 274 has a pair of clamping jaws 276 and 278 which are spaced to require an insertion force of from 5 to 10 lbs. With this configuration the bed joint 228 height specification is readily maintained. As differentiated from the first two embodiments, the dry wall construction system 210 provides for the structural integrity by the securement of the veneer anchor construction to the channel member. The anchoring system hereof meets building code requirements for seismic construction and the wall structure reinforcement of both the inner and outer wythes exceeds the testing standards therefor.

In FIG. 9, the compression of wire formatives is shown schematically. For purposes of discussion, the elongation of the compressed wire is disregarded as the elongation is negligible and the cross-sectional area of the construct remains substantially constant. Here, the veneer tie 244 is formed from 0.187-inch diameter wire. The partially compressively reduced portion C is reduced up to 75% of original diameter to a thickness of 0.113 inch.

Analytically, the circular cross-section of a wire provides greater flexural strength than a sheetmetal counterpart. In the embodiments described herein the partially compressively reduced portion C of the veneer tie 244 is cold-worked or partially flattened so that the specification is maintained and high-strength portions are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 9. The deformed body has substantially the same cross-sectional area as the original wire. In each example in FIG. 9, progressive deformation of a wire is shown. Disregarding elongation and noting the prior comments, the topmost portion shows the original wire having a radius, $r_1=1$; and area, $A_1=\Pi$; length of deformation, L=0; and a diameter, $D_1$. Upon successive deformations, the illustrations shows the area of circular cross-section bring progressively ½, % and ¼ of the area, $A_1$, or $A_2=½\ \Pi$; $A_3=⅜\Pi$; and $A_4=¼\ \Pi$, respectively. With the first deformation, the rectangular portion has a length L=1.11r (in terms of the initial radius of 1); a height, $h_2=1.14$; ($D_2=0.71D_1$, where D=diameter); and therefore has an area of approximately ½ Π. Likewise, with the second deformation, the rectangular portion has a length, L=1.38r; a height, $h_3=1.14$; a diameter $D_3=0.57D_1$; and therefore has an area of approximately ⅝Π. Yet again, with the third deformation, the rectangular portion has a length, L=2.36r; a height $h_4=1$; a diameter, degree of plastic deformation to remain at a 0.300 inch (approx.) combined height for the truss and wall tie can, as will be seen hereinbelow, be used to optimize the high-span pintle anchoring system.

In testing the high-strength veneer tie described hereinabove, the test protocol is drawing from ASTM Standard E754-80 (Reapproved 2006) entitled, *Standard Test Method for Pullout Resistance of Ties and Anchors Embedded in Masonry Mortar Joints*. This test method is promulgated by and is under the jurisdiction of ASTM Committee E06 on Performance of Buildings.

In forming the partially compressively reduced portion, the wire body of up to 0.375-inch in diameter is compressed up to 75% of the wire diameter. When compared to standard, wire formatives having diameters in the 0.172- to 0.195-inch range, the partially compressively reduced portion by one-third from the same stock as the standard tie showed upon testing a tension and compression rating that was at least 130% of the rating for the standard tie.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength pintle anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said system comprising:

a wall anchor adapted to be fixedly attached to said inner wythe and have a free end thereof extend into said cavity, said free end of said wall anchor comprising:

one or more receptor portions adapted to be disposed in said cavity, said one or more receptor portions being openings disposed substantially horizontally; and, a wire-formative veneer tie having an insertion portion for disposition in said bed joint and a cavity portion for interengagement with said one or more receptor portions, said cavity portion further comprising:

a leg portion being at one end thereof contiguous with and extending from said insertion portion;

a joint portion adjoining said leg portion at the end opposite said insertion portion;

a pintle portion extending from said joint portion and dimensioned for interengagement with said one or more receptor portions;

said wire-formative veneer tie being partially compressively reduced from a point medial said leg portion through said joint portion and to a point medial said pintle portion.

2. A high-strength pintle anchoring system as described in claim 1 wherein said one or more receptors further comprise two eyelets spaced apart at a predetermined interval; and, said wire-formative veneer tie has two pintle portions partially compressively reduced for interengaging said receptor portions with each of said pintle portions dimensioned to closely fit one of said openings of said two receptor portions.

3. A high-strength pintle anchoring system as described in claim 2 wherein each of said two eyelets is welded closed and has a substantially circular opening therethrough with a predetermined diameter.

4. A high-strength pintle anchoring system as described in claim 3 wherein said inner wythe is formed from successive courses of masonry block with a bed joint of predetermined height between each two adjacent courses and has a reinforcement ladder or truss in said bed joint, said wall anchor further comprising:

a wire formative fixedly attached to said reinforcement having at least two legs extending into and terminating within said cavity.

5. A high-strength pintle anchoring system as described in claim 4 wherein said receptor portions are two wire-formative eyelets adapted to be disposed substantially horizontally in said cavity.

6. A high-strength pintle anchoring system as described in claim 5 wherein each of said two wire-formative eyelets is welded closed and has a substantially circular opening therethrough with a predetermined diameter.

7. A high-strength pintle anchoring system as described in claim 6 wherein a width of each of said pintle portions is in a close fitting functional relationship with said diameter of said eyelet.

8. A high-strength pintle anchoring system as described in claim 7 wherein the widths of said pintle portions are substantially parallel to the longitudinal axes of said legs of said wall anchor.

9. A high-strength pintle anchoring system as described in claim 8 wherein said veneer tie is a wire formative and said pintle portions are compressively reduced in thickness up to 75% of the original diameter thereof.

10. A high-strength pintle anchoring system as described in claim 9, wherein said anchoring system further comprises:

a reinforcement wire adapted to be disposed in said bed joint; and, wherein said veneer tie insertion portion further comprises:

one or more housings each having a clamping jaw for receiving said reinforcement wire;

whereby, upon installation of said anchoring system with an interconnected reinforcing wire in said outer wythe, said system provides a high degree of seismic protection.

11. A high-strength pintle anchoring system as described in claim 1 wherein said inner wythe is a dry wall structure having wallboard panels mounted on columns or framing members, said wall anchor further comprising:

a surface-mounted sheetmetal bracket adapted to be fixedly attached to said columns of said inner wythe, said sheetmetal bracket being L-shaped and having a mounting portion and an extending portion for extending substantially horizontally into said cavity, said extending portion with said one or more receptor portions therethrough.

12. A high-strength pintle anchoring system as described in claim 11 wherein said one or more receptors further comprise two apertures spaced apart at a predetermined interval; and, said wire-formative veneer tie has two pintle portions partially compressively reduced for interengagement with said anchor receptor portions.

13. A high-strength pintle anchoring system as described in claim 12 wherein each of said two apertures are shaped substantially similar to the cross section of said pintle portions.

14. A high-strength pintle anchoring system as described in claim 12 wherein a width of each of said pintle portions is in a close fitting functional relationship with the opening of said aperture.

15. A high-strength pintle anchoring system as described in claim 12 wherein the widths of said pintle portions are substantially normal to said wallboard panels.

16. A high-strength pintle anchoring system as described in claim 15 wherein said anchoring system further comprises:

a reinforcement wire adapted to be disposed in said bed joint; and, wherein said veneer tie insertion portion further comprises:

one or more housings each having a clamping jaw for receiving said reinforcement wire;

whereby, upon installation of said anchoring system with an interconnected reinforcing wire in said outer wythe, said system provides a high degree of seismic protection.

17. A high-strength pintle anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said system comprising:

a wall anchor adapted to be fixedly attached to said inner wythe and have a free end thereof extend into said cavity, said free end of said wall anchor comprising:

one or more receptor portions adapted to be disposed in said cavity, said one or more receptor portions being openings disposed substantially horizontally; and, a wire-formative veneer tie for disposition in said bed joint and for interengagement with said one or more receptor portions, said veneer tie further comprising:

an insertion portion adapted to be disposed in said bed joint, said insertion portion configured to maximize surface contact with said mortar; and, a cavity portion for interengagement with said one or more receptor portions, said cavity portion further comprising:

a leg portion being at one end thereof contiguous with and extending from said insertion portion into said cavity;

a joint portion adjoining said leg portion at the end opposite said insertion portion;

a pintle portion extending from said joint portion and dimensioned for interengagement with said one or more receptor portions;

said wire-formative veneer tie being partially compressively reduced from a point medial said leg portion through said joint portion and to a point medial said pintle portion.

18. A high-strength pintle anchoring system as described in claim 17 wherein said insertion portion further comprises:

two hooks set opposite each other, said hooks contiguous with and extending from said leg portion; and an insertion bar contiguous with and connecting said hooks, said insertion bar set opposite said leg portion.

19. A high-strength pintle anchoring system as described in claim 18 wherein said one or more receptors further comprise two eyelets spaced apart at a predetermined interval; and, said wire-formative veneer tie has two pintle portions partially compressively reduced for interengaging said veneer tie with each of said pintle portions dimensioned to closely fit one of said openings of said two receptor portions.

20. A high-strength pintle anchoring system as described in claim 19 wherein each of said two eyelets is welded closed and has a substantially circular opening therethrough with a predetermined diameter.

21. A high-strength pintle anchoring system as described in claim 20 wherein said inner wythe is formed from successive courses of masonry block with a bed joint of predetermined height between each two adjacent courses and has a reinforcement ladder or truss in said bed joint, said wall anchor further comprising:

a wire formative fixedly attached to said reinforcement having at least two legs extending into and terminating within said cavity.

22. A high-strength pintle anchoring system as described in claim 21 wherein said receptor portions are two wire-formative eyelets adapted to be disposed substantially horizontally in said cavity.

23. A high-strength pintle anchoring system as described in claim 22 wherein each of said two wire-formative eyelets is welded closed and has a substantially circular opening therethrough with a predetermined diameter.

24. A high-strength pintle anchoring system as described in claim 23 wherein a width of each of said pintle portions is in a close fitting functional relationship with said diameter of said eyelet.

25. A high-strength pintle anchoring system as described in claim 24 wherein the widths of said pintle portions are substantially parallel to the longitudinal axes of said legs of said wall anchor.

26. A high-strength pintle anchoring system as described in claim 25 wherein said veneer tie is a wire formative and said partially compressively reduced portion is compressively reduced in thickness up to 75% of the original diameter thereof.

27. A high-strength pintle anchoring system as described in claim 18 wherein said inner wythe is a dry wall structure having wallboard panels mounted on columns or framing members, said wall anchor further comprising:

a surface-mounted sheetmetal bracket adapted to be fixedly attached to said columns of said inner wythe, said sheetmetal bracket being L-shaped and having a mounting portion and an extending portion for extending substantially horizontally into said cavity, said extending portion with said one or more receptor portions therethrough.

28. A high-strength pintle anchoring system as described in claim 27 wherein said one or more receptors further comprise two apertures spaced apart at a predetermined interval.

29. A high-strength pintle anchoring system as described in claim 28 wherein each of said two apertures are shaped substantially similar to the cross section of said pintle portions.

30. A high-strength pintle anchoring system as described in claim 28 wherein said a width of each of said pintle portions is in a close fitting functional relationship with the opening of said aperture.

31. A high-strength pintle anchoring system as described in claim 28 wherein the widths of said pintle portions are substantially normal to said wallboard panels.

32. A high-strength pintle anchoring system for use in a cavity wall formed from a backup wall and a facing wall in a spaced apart relationship with a vertical surface of the backup wall forming one side of a cavity therebetween, said cavity in excess of four inches, said backup wall formed from a plurality of successive courses of masonry block with a bed joint of predetermined height between each two adjacent courses, said facing wall formed from a plurality of courses with a bed joint of predetermined height between each two adjacent courses, said high-strength pintle anchoring system comprising, in combination:

a wall reinforcement with an upper surface in one plane and a lower surface in a plane substantially parallel thereto, said wall reinforcement adapted for mounting in said bed joint of said backup wall;

at least one wall anchor fusibly attached at an attachment end thereof to said wall reinforcement, and, upon installation in said bed joint of said backup wall, extending between said plane of said upper surface and said plane of said lower surface from an attachment end thereof to the vertical surface of said backup wall; said wall anchor, in turn, comprising:

an extended leg portion for spanning said cavity, said extended leg portion having a free end contiguous therewith, opposite said attachment end, and having one or more receptor portions therein; and, a wire-formative veneer tie having an insertion end portion for disposition in said bed joint of said facing wall a leg portion extending from the insertion end portion, and a partially compressively reduced pintle forming an interengaging end portion for disposition into said one or more receptor portions of said wall anchor said wire-formative veneer tie being partially compressively reduced from a point medial said leg portion to a point medial said pintle portion.

33. A high-strength pintle anchoring system as described in claim 32 wherein said wall anchor has two extended leg portions each having a receptor, said receptors further comprise two eyelets spaced apart at a predetermined interval; and, said wire-formative veneer tie has two partially compressively reduced pintles formed by compressively reducing said interengaging end portion of said veneer tie with each of said partially compressively reduced pintles dimensioned to closely fit one of said openings of said two receptor portions.

34. A high-strength pintle anchoring system as described in claim 33 wherein each of said two eyelets is welded closed and has a substantially circular opening therethrough with a predetermined diameter.

35. A high-strength pintle anchoring system as described in claim 34 wherein said receptor portions are two wire-formative eyelets adapted to be disposed substantially horizontally in said cavity.

36. A high-strength pintle anchoring system as described in claim 35 wherein a width of each of said partially compressively reduced pintles is in a close fitting functional relationship with said diameter of said eyelet.

37. A high-strength pintle anchoring system as described in claim 36 wherein the widths of said partially compressively reduced pintles are substantially parallel to the longitudinal axes of said legs of said wall anchor.

38. A high-strength pintle anchoring system as described in claim 37 wherein said veneer tie is a wire formative and said partially compressively reduced pintles of said interengaging end portion at least one partially compressively reduced portion is compressively reduced in thickness up to 75% of the original diameter thereof.

39. A high-strength pintle anchoring system as described in claim 38, wherein said veneer tie is fabricated from a wire having a diameter of up to 0.375-inch and wherein said engaging end portion thereof is compressively reduced up to 75%.

40. A high-strength pintle anchoring system as described in claim 39, wherein said partially compressively reduced pintle is fabricated from a 3/16⁻ inch wire, when reduced by one-third has a tension and compression rating at least 130% of the rating for a non-reduced pintle.

* * * * *

UNITED STATES PATENT AND TRADEMARK OFFICE

CERTIFICATE OF CORRECTION

PATENT NO. : 8,726,596 B2
APPLICATION NO. : 13/425930
DATED : May 20, 2014
INVENTOR(S) : Ronald P. Hohmann, Jr.

It is certified that error appears in the above-identified patent and that said Letters Patent is hereby corrected as shown below:

In the claims

In Column 14, Claim 17, Lines 55-56:
"into said cavity" should be deleted

In Column 15, Claim 30, Line 65:
"said" after "claim 28 wherein" should be deleted Signed and Sealed this
Twenty-second Day of March, 2016

Michelle K. Lee

Michelle K. Lee
*Director of the United States Patent and Trademark Office*